United States Patent [19]

Calder

[11] Patent Number: 4,540,865

[45] Date of Patent: Sep. 10, 1985

[54] PUSH BUTTONS

[75] Inventor: John Calder, Woodthorpe, England

[73] Assignee: Plessey Overseas Limited, Ilford, England

[21] Appl. No.: 584,626

[22] Filed: Feb. 29, 1984

[30] Foreign Application Priority Data

Mar. 1, 1983 [GB] United Kingdom ..... 8305647
Aug. 23, 1983 [GB] United Kingdom ..... 8322649

[51] Int. Cl.[3] ..... H01H 13/52; H01H 13/06

[52] U.S. Cl. ..... 200/340; 200/159 B; 200/302.3; 200/5 A

[58] Field of Search ..... 200/159 B, 340, 302.2, 200/5 A

[56] References Cited

U.S. PATENT DOCUMENTS

| | | | |
|---|---|---|---|
| 3,860,771 | 1/1975 | Lynn et al. | 200/340 |
| 3,932,722 | 1/1976 | Obata et al. | 200/302.2 |
| 4,021,630 | 5/1977 | Taylor | 200/302.2 |
| 4,347,504 | 8/1982 | Murofushi et al. | 200/5 A |
| 4,390,765 | 6/1983 | Sado et al. | 200/159 B |
| 4,491,702 | 1/1985 | Kato | 200/340 |

FOREIGN PATENT DOCUMENTS

| | | | |
|---|---|---|---|
| 0051749 | 5/1982 | European Pat. Off. . | |
| 1207469 | 12/1965 | Fed. Rep. of Germany | 200/302.2 |
| 1375333 | 11/1974 | United Kingdom . | |
| 2043349A | 10/1980 | United Kingdom . | |
| 2062965A | 5/1981 | United Kingdom . | |
| 2071420A | 9/1981 | United Kingdom . | |
| 2082840A | 3/1982 | United Kingdom . | |
| 2089573A | 6/1982 | United Kingdom . | |
| 2100517 | 12/1982 | United Kingdom . | |
| 2112577A | 7/1983 | United Kingdom . | |

*Primary Examiner*—John W. Shepperd
*Attorney, Agent, or Firm*—Fleit, Jacobson, Cohn & Price

[57] ABSTRACT

A keyboard (61) is provided with rubber (silicone) buttons (64, 66) with collapsible webs (14) connecting the buttons to a base layer (10, 40, 60). A solid finger of rubber (20) underneath each button actuates a membrane switch (23) underneath the button. Additionally or alternatively a conductive member (52) can be attached to the end of the finger (20) to make two contacts (48, 50, 56, 58). The buttons and the finger can be of any suitable section, such as round, rectangular etc., and a variety of types of membrane switches can be used.

7 Claims, 6 Drawing Figures

PUSH BUTTONS

This invention relates to push buttons and more particularly to a push button adapted to be mounted over a switch whereby depression of the push button operates the switch. An example is a keyboard comprising a plurality of push button switches in which long life of the keyboard and low cost is important.

According to the present invention a push button comprises a cover member of resilient material having a base portion adapted to contact a surface, a wall portion projecting from the base portion to a cover portion to form a hollow enclosed space above the surface, the wall portion including a relatively flexible deforming part and a relatively stiffer guide part, both extending completely around the hollow enclosed space, the cover portion having a relatively rigid substantially flat outer surface and a projection on its inner surface whereby a predetermined force on the cover portion by a finger of a user causes deformation of the deforming part such that the projection contacts the surface, the guide part being adapted to co-operate with guide means whereby the projection moves in a direction substantially perpendicular to the surface.

Preferably the deforming part requires a higher force to initially deform and a lower force to complete deformation to give a tactile feedback to the user.

Preferably the projection tapers from the cover portion from substantially the same cross-sectional area as the inner surface, of the cover portion to a smaller area whereby the end of the projection is distortable to a degree.

The deforming part preferably has a cross-sectional shape of substantially a quarter circle extending substantially perpendicularly both from the base portion and from the guide part.

A stop portion may be formed on the end of the guide part adjacent to the connection between the guide part and the deforming part, the stop portion contacting the surface when the end of the projection distorts in shape against the surface.

Figure 1:
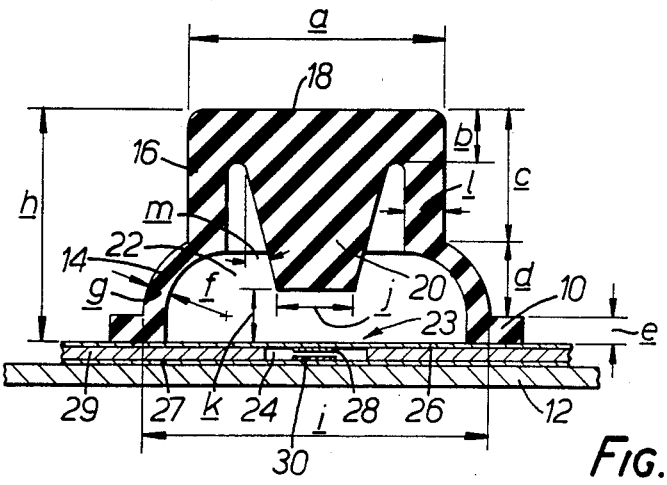
Figure 2:
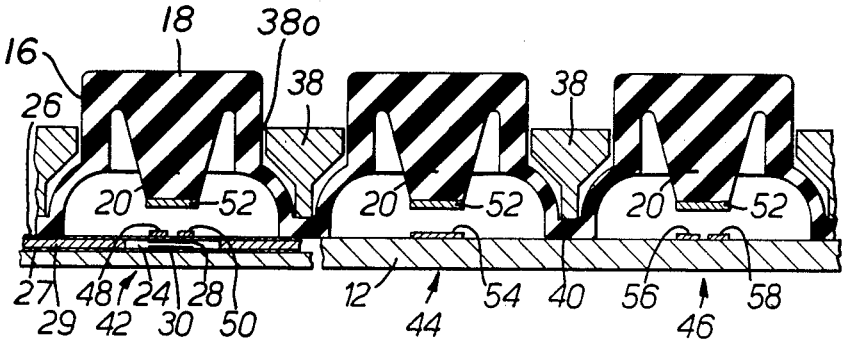

Embodiments of the invention will now be described by way of example only with reference to the accompanying drawings in which:

FIG. 1 is a cross-sectional view of a push button according to the present invention mounted over a switch, FIG. 2 is a cross-sectional view of a number of push button switches forming part of a keyboard.

Figure 3:
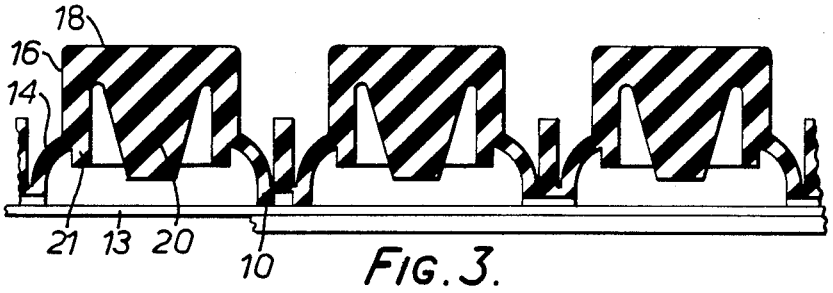
Figure 4:
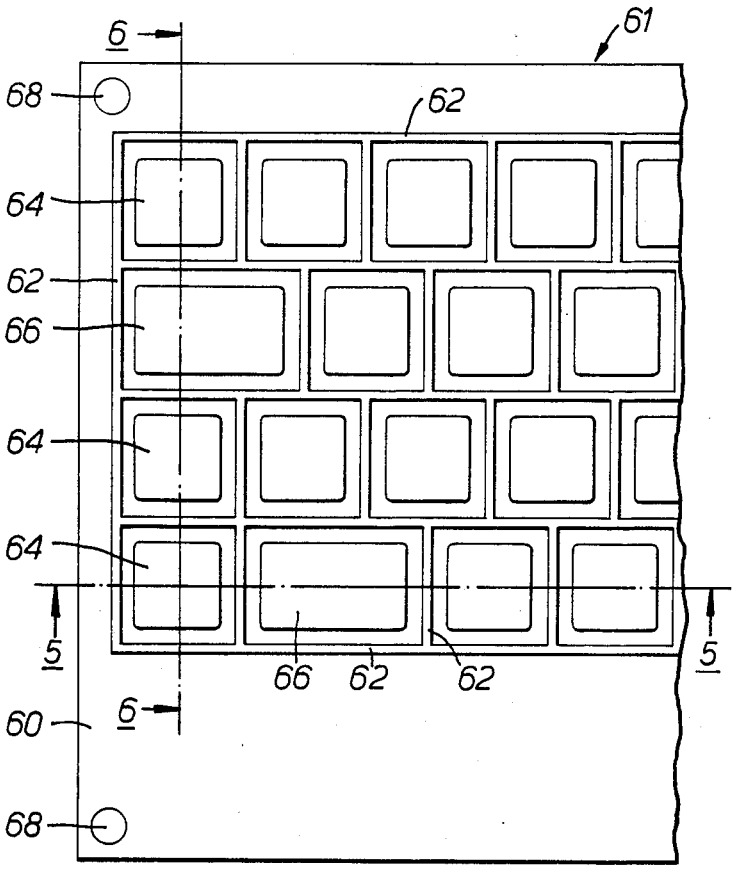
Figure 5:
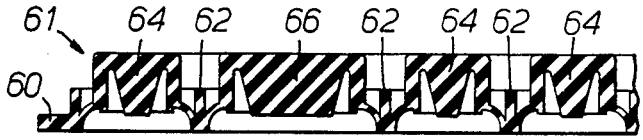
Figure 6:
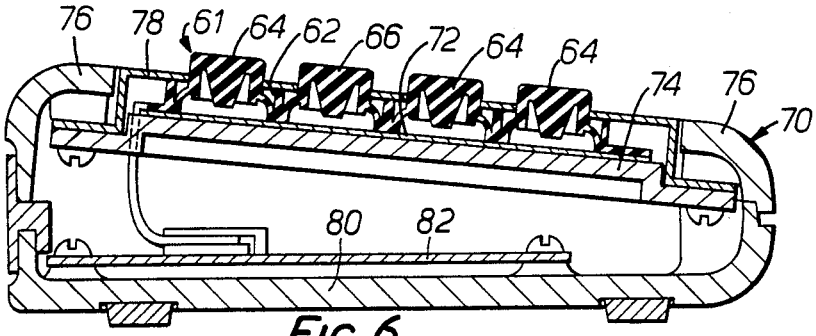

FIG. 3 is a cross-sectional view of a number of push buttons having a slightly modified construction, FIG. 4 is a plan view of an array of push buttons as shown in FIG. 3 having a common base, FIG. 5 is a cross-sectional view taken along line 5—5 of FIG. 4 and, FIG. 6 is a cross-sectional view of an electrical apparatus having a plurality of push buttons of the kind shown in FIG. 3, the push buttons being shown in cross-section taken along line 6—6 of FIG. 3.

The push button switch shown in FIG. 1 comprises a base 10 which supports the push button on a flat surface such as a membrane switch 23 mounted on a base member in the form of a printed circuit board 12. The push button has side walls projecting from the base 10, the sidewalls consisting of two parts or portions: an arcuate part or portion 14 and a guide part or portion 16. A cover portion 18 connects the sidewalls forming a hollow enclosed space 22 above the printed circuit board 12. A tapering projection 20 extends from the cover portion 18 into the enclosed space terminating near to the membrane switch 23.

The arcuate portion 14 extends substantially perpendicularly from the base portion 10 through almost a quarter of a circle to meet the guide portion 16 at around 90°, the guide portion also being substantially perpendicular to the base portion 10. The arcuate portion is also substantially thinner than the guide portion 16, being comparatively flexible whilst the guide portion is relatively stiff. The end of the tapering projection 20 adjacent to the cover portion 18 is almost the same size as the internal dimensions as the top portion so that the top portion is very stiff and comparatively non-distortable. The thinner or tip end of the projection 20 is distortable to a degree.

The arcuate portion and the guide portion extend completely round the periphery of the push button, the guide portion being adapted to co-operate with a cover member such as 38 in FIG. 2 and 78 in FIG. 6 so that the push button moves substantially perpendicular to the mounting surface. The complete push button is formed integrally from a resilient material such as rubber or silicone polymer and can have any suitable shape in plan view such as square, rectangular, circular or polygonal. The projection 20 may have similar profiles.

When the cover portion 18 of the push button is depressed the arcuate portion 14 of the sidewalls, being the thinnest part, distorts in shape, becoming more arcuate until when a predetermined pressure is applied the arcuate portion collapses giving a tactile feedback to the user and the end of the projection 20 contacts the membrane switch 23. When the pressure is removed from the cover portion 18, the push button returns to its original shape.

It has been found that suitable dimensions for such a button are:

| | |
|---|---|
| width of top portion | a = 10 mm (square or round) |
| thickness of top portion | b = 2 mm |
| height of straight portion of sidewalls | c = 5 mm |
| height of arcuate portion of sidewalls | d = 4 mm |
| thickness of base | e = 1 mm |
| radius of arcuate portion | f = 2.8 mm |
| thickness of arcuate portion of sidewalls | g = 0.5 mm |
| overal height of button | h = 9 mm |
| overall width of arcuate portion of sidewalls | i = 13–14 mm |
| width of end of projection | j = 3 mm (square or round) |
| height of end of projection above printed circuit | k = 1.5 mm |
| thickness of straight portion of sidewalls | l = 1.5 mm |
| angle of taper of projection | m = 15° |
| collapse force | = 1.5–2.4 newtons |

All these dimensions are approximate only, but some of the ratios between them are important.

The printed circuit board 12 shown in FIG. 1 includes a membrane switch 23 located directly under the push button. The membrane switch is mounted on top of the printed circuit board 12 and comprises two insulating membranes 26 and 27 spaced apart by a resilient sheet 29 having a hole 24 formed therethrough. On the upper surface of the membrane 27 in line with the hole 24 is deposited a coating 30 of silver loaded paint. On the lower surface of the membrane 26 also in line with the hole 24 is also deposited a coating 28 of silver loaded paint. Thus when the push button is depressed and the arcuate portion of the sidewalls collapses the end of the projection 20 contacts the membrane 26 and urges the coating 28 into contact with the coating 30. Any suitable electrical circuit can be connected to the coatings 28 and 30.

The push button can be moulded with a suitable marking such as a raised or depressed character or a different coloured character applied to the cover portion 18 or markings can be applied after moulding and no additional cap, covering or plunger member is needed over the push button.

An array of push buttons can be made in a single moulding in the form of a mat as shown in FIG. 2, using a common base 40. Any suitable arrangement of push buttons can be used to make up a keyboard, and the push buttons can have various different sections in plan view or can have all the same section. A cover member or guide plate 38, having openings 38*o* for receiving the guide wall portions 16 and the cover portions 18 of the push buttons, is used to hold the keyboard in position and to guide the push buttons when they are depressed.

Various different types of switch can be operated by the push button, and three further examples 42, 44 and 46 are illustrated in FIG. 2. The switch 42 is a membrane switch as illustrated in FIG. 1 with the addition of two extra coatings 48 and 50 of silver loaded paint on the upper side of the membrane 26. A conductive contact 52 is formed on the end of the projection 20 so that a double switch action is obtained when the push button is depressed, the contact 52 bridging the coatings 48 and 50 when the coatings 28 and 30 touch. The switches 44 and 46 also use conductive contacts 52 formed on the end of the projection 20. In switch 44 the contact 52 merely makes with a further contact 54 secured to the printed circuit board 12 and in switch 46 the contact 52 bridges two contacts 56 and 58 mounted side-by-side on the printed circuit board.

FIG. 3 is a cross-sectional view of an array of three push buttons having slightly modified profiles to those shown in FIGS. 1 and 2. The guide portions 16 have an extended portion 21 extending towards the mounting surface 13, this portion extending completely round the periphery of the push button. This acts to prevent rocking of the button about the end of the projection 20 when it contacts the surface 13. Since the extended portion 21 does not have such a large loading as the guide portions 16 it is thinner and slightly more resilient. A typical thickness for the extension is 1 mm and the end of the extension is of the order of 0.5 mm shorter than the projection 20.

In FIG. 4 there is shown in plan view an array 61 of push buttons on a common base 60. A cross-sectional view taken along line 5—5 (FIG. 5) shows a slightly modified arrangement to that shown in FIG. 2 in that webs 62 extending perpendicularly to the base 60 are provided around each push button. These webs are adapted to support a cover member and it has been found that this arrangement reduces any tendency for the base portion 60 to distort around a push button which is depressed causing distortion of adjacent push buttons. FIGS. 4 and 5 also illustrate push buttons of differing shapes, such as the square push buttons 64 and the rectangular buttons 66. No contacts are shown since any of the contact arrangements shown in FIGS. 1 and 2 can be used for any of the push buttons. Holes 68 positioned at suitable locations around the array provide locating means for the array 61.

FIG. 6 illustrates the array 61 assembled in an electrical apparatus 70 which may be, for example, the keyboard of a telecommunications system, a computer or a word processor.The array 61 of push buttons is shown sectioned along the line 6—6 of FIG. 4 and is mounted on a printed circuit board 72 supported on a plate 74. The plate 74 is bolted to the upper housing 76 of the apparatus, and a cover or guide plate 78 is clamped between the two so as to rest on the webs 62. The upper housing 76 is mounted on a lower housing 80 which includes a further printed circuit board 82 containing the appropriate electrical circuits.

I claim:

1. A push button device, comprising:

a moulded resilient body;

a substantially flat base member having electrical contacts, said moulded resilient body and base member forming a sealed hollow enclosure; and a guide plate having at least one opening therein, said moulded resilient body partially protruding through the opening in said guide plate;

said moulded resilient body comprising an inner flat base portion attached and parallel to said base member, a side wall portion which includes an arcuate deformable portion of essentially quarter-circle configuration in cross-section, and a substantially rigid guide portion which partially protrudes through the opening in said guide plate;

said moulded resilient body further comprising a substantially flat outer cover portion extending parallel to the base portion, and a tapered projection having a resilient deformable tip;

said flat base portion of said moulded resilient body being integral with an inner end of said arcuate deformable wall portion in a substantially perpendicular relationship, said substantially rigid guide wall portion being substantially perpendicular to said base member and to an outer end of said arcuate deformable wall portion and having an inner end integral with the outer end of said arcuate deformable wall portion, said cover portion being substantially parallel to the base portion and integral with an outer end of said rigid guide wall portion, said tapered projection being integral with said cover portion and projecting from substantially an entire internal surface area of said cover portion to present a reduced inner tip surface area extending parallel to said base member, with said reduced inner surface area being located over said base member electrical contacts, said guide plate being shaped and mounted to restrict movement of the base portion of said moulded resilient body relative to said base member; and said moulded resilient body arcuate deformable wall portion deforming when a load is applied to said cover portion, causing substantially perpendicular movement of said tapered projection toward said base member and a two-stage deformation of tactile response by said arcuate deforming wall portion, said tapered projection after the second stage of deformation causing electrical connection between said base member contacts but having sufficient deformability in its tip to prevent excessive load being applied to said base member and causing damage thereto.

2. A push button device as claimed in claim 1, in which a stop portion is formed on the inner end of the rigid guide portion adjacent to the connection between the guide portion and the arcuate deformable portion and extends beyond the connection toward said base member, the stop portion contacting a surface of said base member when the end of the projection distorts in shape against the surface, to prevent overtilting of the push button relative to said guide plate.

3. A push button device as claimed in claim 1, in which said arcuate deformable sidewall portion of said moulded resilient body is substantially thinner than said rigid guide wall portion so as to be comparatively flexible with respect to said rigid guide portion.

4. A push button device as claimed in claim 1, in which support webs extend from said base portion of said moulded resilient body to support said guide plate on said base portion.

5. An assembly of push buttons which extends in two dimensions in the form of a keyboard, comprising:

a moulded resilient mat;

a guide plate with a plurality of openings therein; and a base plate having a plurality of sets of electrical contacts;

said moulded resilient mat having a plurality of moulded structures each comprising a two-part sidewall which includes an arcuate deformable part of substantially quarter-circle configuration in cross-section, and a substantially rigid guide part;

each of said moulded structures also including an outer cover portion and a tapering projection facing inward from said cover portion, and said moulded resilient mat also having an area of flat resilient material between each moulded structure;

said sidewall arcuate deformable part of each moulded structure having opposite ends integral with and perpendicular to said flat resilient material and said sidewall rigid guide part, respectively, said rigid guide part also being integral with and perpendicular to said cover portion, and said projection being integral with said cover portion and tapering from substantially the entire internal surface of said cover portion to provide a reduced inner surface adjacent said base plate;

said rigid guide portions of said moulded structures projecting through respective ones of the openings in said guide plate and said tapered projection being located over respective sets of said electrical contacts on said base plate; and said guide plate, moulded resilient mat and base plate forming a sandwich with said guide plate at the top, said moulded resilient mat in the middle and said base plate at the bottom.

6. An assembly as claimed in claim 5, in which said arcuate deformable sidewall portion of each of said moulded structures is substantially thinner than said rigid guide portion of said moulded structure so as to be comparatively flexible with respect to said rigid guide portion.

7. An assembly as claimed in claim 5, in which support webs extend from said moulded resilient mat between said moulded structures to support said guide plate on said moulded resilient mat.

* * * * *